United States Patent [19]

Rosynek et al.

[11] B 3,983,030

[45] Sept. 28, 1976

[54] COMBINATION PROCESS FOR RESIDUA DEMETALATION, DESULFURIZATION AND RESULTING COKE GASIFICATION

[75] Inventors: Michael P. Rosynek, Bryan, Tex.; George F. Shipman; Tsoung-Yuan Yan, both of Trenton, N.J.

[73] Assignee: Mobil Oil Corporation, New York, N.Y.

[22] Filed: Feb. 1, 1974

[21] Appl. No.: 438,916

[44] Published under the second Trial Voluntary Protest Program on January 13, 1976 as document No. B 438,916.

[52] U.S. Cl. ..... 208/253; 48/203; 208/53; 208/67; 208/114; 208/118; 208/120; 208/126; 208/153; 208/165; 208/208 R; 208/245; 208/249; 208/251 R; 252/416

[51] Int. Cl.[2] ..... C10J 3/00; C10G 9/30; C10B 55/00; B01D 15/06

[58] Field of Search ..... 208/119, 243, 249, 120, 208/251 R, 245, 53; 48/203

[56] References Cited

UNITED STATES PATENTS

| | | | |
|---|---|---|---|
| 3,691,063 | 9/1972 | Kirk | 208/91 |
| 3,726,791 | 4/1973 | Kimberlin et al. | 208/127 |
| 3,813,331 | 5/1974 | Weisz et al. | 208/251 |
| 3,825,486 | 7/1974 | Miale | 208/110 |

*Primary Examiner*—Herbert Levine
*Assistant Examiner*—G. E. Schmitkons
*Attorney, Agent, or Firm*—Charles A. Huggett; Raymond W. Barclay; Dennis P. Santini

[57] ABSTRACT

A combination process is provided for residua demetalation and desulfurization and resulting coke gasification which comprises contacting said residua with a porous refractory oxide in the absence of added hydrogen, at a temperature of from greater than 700°F to about 1100°F and a refractory oxide to oil weight ratio of from about 0.1 to about 5 to produce upgraded residua of cracking feed quality, and contacting said refractory oxide after an amount of coke has formed thereon with steam and a free oxygen containing gas in which the mole ratio of steam to oxygen is from about 3 to about 5, at a temperature of from about 1000°F to about 1500°F to produce producer gas and regenerated porous refractory oxide for further contacting with residua.

13 Claims, 2 Drawing Figures

COMBINATION PROCESS FOR RESIDUA DEMETALATION, DESULFURIZATION AND RESULTING COKE GASIFICATION

BACKGROUND OF THE INVENTION

1. Field of the Invention

This invention relates to a combination process for demetalation and desulfurization of residua and gasification of coke thereby resulting. More particularly, this invention relates to a combination process for residua demetalation and desulfurization which comprises contacting said residua with a porous refractory oxide in the absence of added hydrogen and gasification of coke formed thereby on the refractory oxide by contacting said refractory oxide with steam and a free oxygen containing gas.

2. Description of Prior Art

Residual petroleum oil fractions containing relatively high proportions of metals, such as those heavy fractions produced by atmospheric and vacuum crude distillation columns, would represent excellent charge stocks for a cracking process were it not for their high metals content. Principal metal contaminants are nickel and vanadium, with iron and copper also sometimes present. Additionally, trace amounts of zinc and sodium may be present. Since these metals, when present in crude oil, are associated with very large hydrocarbon molecules, the heavier fractions produced by crude distillation contain substantially all the metals present in the crude, such metals being particularly concentrated in the asphaltene residual fraction. The metal contaminants are typically large organometallic complexes such as metal prophyrins.

At present, catalytic cracking operations are performed on petroleum fractions lighter than residual fractions. Typical cracking charge stocks are coker and/or crude unit gas oil, vacuum tower overhead, etc., the feedstock having an API gravity range of between about 15 and about 45. Such charge stocks do not contain significant proportions of the heavy and large molecules in which the metals are concentrated.

When metals are present in a cracking unit charge stock, such metals are deposited on the cracking catalyst. The metals act as a catalyst poison and greatly decrease the efficiency of the cracking process by altering the catalyst so that it promotes increased hydrogen production and coke formation.

The amount of metals present in a given hydrocarbon stream is generally judged by petroleum engineers by making reference to a charge stock's "metal factor", where said factor (F) is equal to the summation of the metal concentration in parts per million of iron and vanadium plus ten times the amount of nickel and copper. The factor may be expressed in an equation form as follows:

$$F = Fe + V + 10\,(Ni + Cu)$$

A charge stock having a metal factor greater than about 3 is indicative of a charge stock which will poison cracking catalyst to a significant degree. A typical Kuwait crude, generally considered of average metals content, has a metal factor of about 150 to about 200. As almost all of the metals are combined with the residual fraction of a crude stock, it is clear that metals removal of over 90% will be required to make such fractions suitable for cracking charge stocks.

Sulfur is also undesirable in a cracking process unit charge stock. The sulfur contributes to corrosion of the unit's mechanical equipment and creates difficulties in treating products and flue gases. At typical cracking conversion rates, about one-half of the sulfur charge to such a unit is converted to $H_2S$ gas which must be removed from the gasoline product, usually by scrubbing with an amine stream. A large portion of the remaining sulfur is deposited on the cracking catalyst itself. When the catalyst is regenerated, at least a portion of this sulfur is oxidized to form $SO_2$ gas which must be removed from the flue gas which is normally discharged into the atmosphere.

In the past, high molecular weight, e.g. residual, stocks containing sulfur and metals have often been processed in a coker to effectively remove metals and also some of the sulfur. However, there are limits to the amount of metals and sulfur which can be tolerated in the product coke if it is to be marketable. Hence, there is a considerable need to develop economically practicable means for effecting the removal and recovery of metallic and sulfur contaminants from high boiling fractions of petroleum oils so that conversion of such contaminated oils to more desirable product may be effectively accomplished. The present application is particularly concerned with the removal of metal and sulfur contaminants from residua and gasification of the coke thereby formed.

It has been proposed to improve the salability of high sulfur and metal content residual-containing petroleum oils by a variety of hydroprocessing methods, e.g. hydrodesulfurization and hydrodemetalation. However, difficulty has been experienced in achieving a commercially feasible catalytic hydroprocessing. Short catalyst life in such processes is manifested by inability of a catalyst to maintain a relatively high capability for desulfurizing charge stock with increasing quantities of coke and/or metallic contaminants deposited thereon which act as catalyst poisons. Satisfactory catalyst life can be obtained relatively easily with distillate oils, but is especially difficult to obtain in desulfurizing residual oils, since the asphaltenic or porphyrinic components of an oil, which tend to form disproportionate amounts of coke, are concentrated in the residual fractions of a petroleum oil, and since a relatively high proportion of the metallic contaminants that normally tend to poison catalysts are commonly found in the asphaltene components of the oil. Further, on a commercial scale, these processes are rather costly due to high hydrogen consumption levels and to the expensive compression and recycling equipment required for high pressure operations. Consequently, there is an economic incentive to develop an upgrading process that does not require added hydrogen.

U.S. Pat. No. 3,716,479 proposes demetalation of a hydrocarbon charge stock by contacting the charge stock with added hydrogen in the presence of a catalyst material derived from a manganese nodule.

By the combination process of the instant invention, economically practicable and effective demetalation/desulfurization of a residual oil is obtained in the absence of added hydrogen.

SUMMARY OF THE INVENTION

Figure 2:
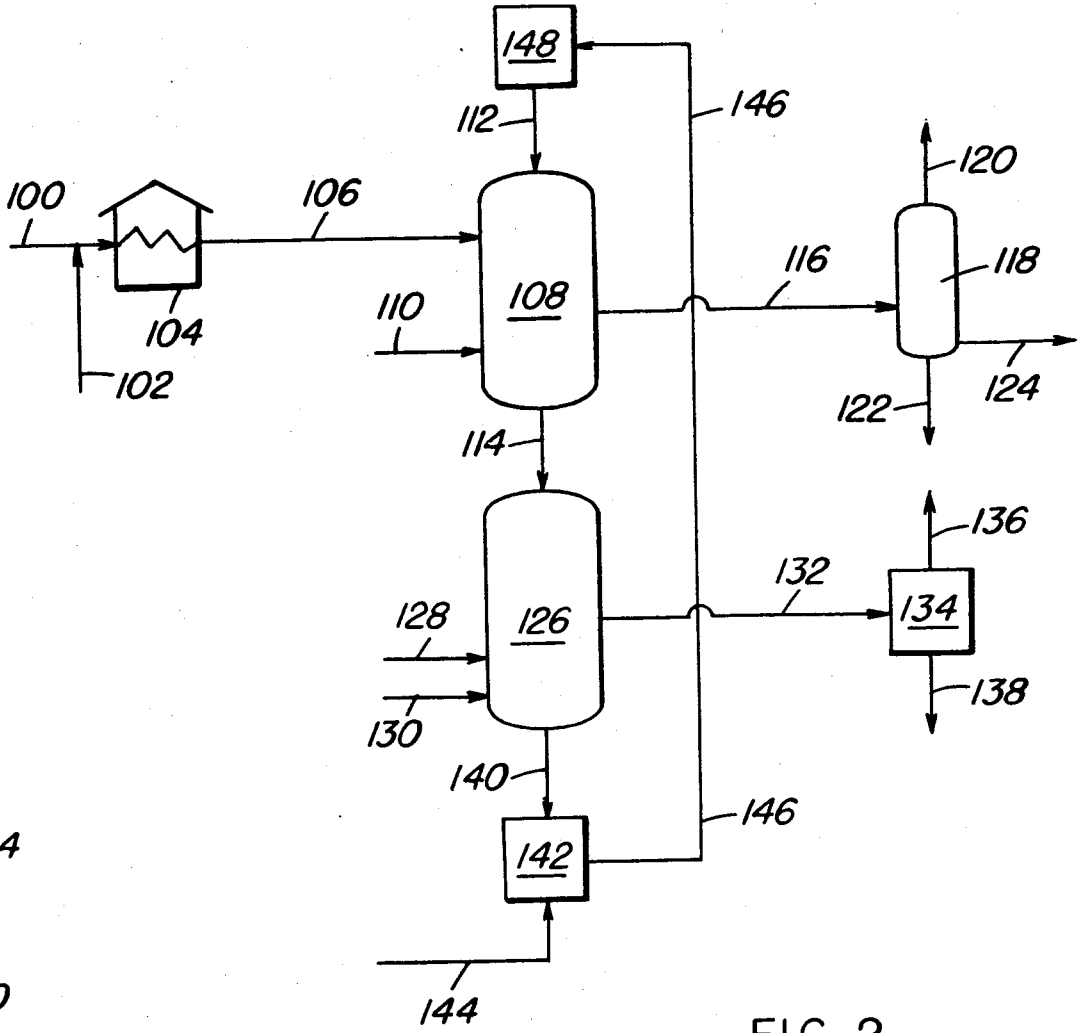
FIG. 2 is a typical schematic flow diagram of the combination process of the present invention.

In accordance with the present invention, residual oil is demetalized and desulfurized by contacting it in the absence of added hydrogen with a porous refractory oxide, preferably one having a major component of silica or alumina or both, at a temperature of greater than 700°F to about 1100°F and a refractory oxide to oil weight ratio of from about 0.1 to about 5 to produce upgraded residual oil of cracking feed quality. Further, after an amount of coke has formed upon the refractory oxide, said coke is gasified by contacting said refractory oxide with steam and a gas containing free oxygen, e.g. air, in which the mole ratio of steam to oxygen is from about 3 to about 5 at a temperature from about 1000°F to about 1500°F to produce producer gas and regenerated coke-free porous refractory oxide for further contacting with residual oil.

DESCRIPTION OF PREFERRED EMBODIMENTS

The combination process of the present invention comprises contacting a residual oil with a specific porous solid in the absence of added hydrogen to produce upgraded residual oil of cracking feed quality and gasifying the coke formed thereby to produce a producer gas and regenerated coke-free porous solid for further contacting with residual oil.

The residual oil which may be treated in accordance with this invention may generally be any high boiling range residual oil boiling above about 400°F. Such residual oil includes components obtained by, for example, fractionation, such as atmospheric or vacuum crude distillation, of crude oils identified by their source i.e. Pennsylvania, Midcontinent, Gulf Coast, West Texas, Amal, Agha Jari, Kuwait, Barco and Arabian. Said residual oil may be one having a substantial portion thereof of the fractionation product of the above mentioned crude oils mixed with other oil stocks.

The porous refractory oxide for use herein can include any type of such material which will brong about demetalation and desulfurization when applied to the residual oil in the absence of added hydrogen, at operating temperatures in the range of greater than 700°F to about 1100°F and a refractory oxide to oil weight ratio of from about 0.1 to about 5. Such refractory oxide materials are known in the art for use in various other processes and include those having a major component of silica or alumina or both. Examples of such refractory oxide materials include alumina, silica, silica-alumina, manganese nodules, crystalline aluminosilicates and combinations thereof.

Non-limiting examples of solid porous refractory oxides useful herein include siliceous materials such as silica and combinations thereof with oxides of metals of Groups II—A, III—A, IV—B and V—B of the Periodic Table, such as, for example, silica-alumina, silica-magnesia, silica-zirconia, silica-thoria, silica-beryllia, silica-titania, as well as ternary compositions of silica, such as, for example, silica-alumina-thoria and silica-alumina-zirconia.

Further non-limiting examples of solid porous refractory oxides useful herein include crystalline aluminosilicate materials such as the synthetic zeolites A, B, L, T, X, Y, ZK—4, ZK—5, ZSM—4, ZSM—5 and others, and the naturally occurring zeolites levynite, dachiarite, erionite, faujasite, analcite, paulingite, noselite, phillipsite, chabazite, leucite, mordenite, ferrierite and others.

When a particular solid porous refractory oxide is selected for use herein, it may have deposited or exchanged thereon one or more of various metal components in keeping with the spirit and scope of the invention. For example, alumina and a siliceous material as above defined may have deposited thereon a metal of Groups VIB or VIII of the Periodic Table of the Elements or an oxide of such a metal, e.g. Co, Mo, $MoO_3$ and $CrO_3$. Also, for example, a crystalline aluminosilicate for use herein may have exchanged thereon metal cations of Groups IB-VIII of the Periodic Table, especially metals of Groups II and III, including the rare earth metals, tin, lead, metals of the actinide series, antimony, bismouth and chromium. Further, a crystalline aluminosilicate for use herein may be incorporated into a naturally-occurring inorganic material, such as, for example clay and metal oxides.

Manganese nodules for use as the porous refractory oxide of the present invention are readily available in large quantities and are relatively inexpensive. They are naturally occurring deposits of manganese, along with other metals, including iron, cobalt, nickel and copper, found on the floor of bodies of water. They are found in abundance on the floors of oceans and lakes. For example, they are found in abundance on the floor of the Atlantic and Pacific Oceans and on the floor of Lake Michigan. The nodules are characterized by a large surface area, i.e. in excess of 150 square meters per gram. The nodules have a wide variety of shapes but most often those from the oceans look like potatoes. Those from the floor of bodies of fresh water, such as the floor of Lake Michigan, tend to be smaller in size. Their color varies from earthy black to brown depending upon their relative manganese and iron content. The nodules are porous and light, having an average specific gravity of about 2.4. Generally, they range from one-eighth inch to 9 inches in diameter but may extend up to considerably larger sizes approximating 4 feet in length and 3 feet in diameter and weighing as much as 1,700 pounds. In addition to the metals mentioned above, the nodules contain silicon, aluminum, calcium and magnesium, and small amounts of molybdenum, zinc, lead, vanadium, and rare earth metals.

The nodules have a high surface area, about 100–250 square meters per gram. They will, however, lose surface area by metal deposition during the demetalation reaction. Further, as shown by Roger G. Burns and D. W. Fuerstenau in *American Mineralogist*, Vol. 51, 1966, pages 895–902, "Electron-Probe Determination of Inter-Element Relationships in Manganese Nodules", the concentrations of the various metals contained in the nodules, i.e., the manganese, iron, cobalt, copper, and nickel, are not uniform throughout the crystalline structure of the nodule. Rather, a traverse across a section of a nodule will show marked differences in the concentrations of the various metals from point to point of the traverse. However, there appears to be a correlation between the concentrations of iron and cobalt. On the other hand, manufactured catalysts for demetalation are usually as uniform as the manufacturer can achieve.

The manganese nodules can be employed as the refractory oxide for the demetalation/desulfurization step of the present invention substantially as mined, or recovered, from the floor of the body of water in which they occurred. Thus, the nodules, as mined, possibly after washing to remove sea water or lake water therefrom and mud or other loose material from the surface of the nodules, may be employed for demetalation and desulfurization.

The demetalation/desulfurization reaction may also be carried out employing, as the refractory oxide, manganese nodules which have been subjected to a pretreatment. Pretreatments to which the manganese nodules may be subjected include sulfiding or leaching to remove therefrom one or more components of the nodules.

The nodules, with or without pretreatment, may be crushed and sized to obtain a desired particle size depending upon the type of demetalation/desulfurization operation employed, for example, a fixed bed operation, an ebullition operation or otherwise.

The operating parameters in the present combination process are critical to achieving the desired results of degrees of demetalation and desulfurization of the residual oil being treated thereby without substantial loss in yield. Further, the operating parameters with respect to the resulting coke gasification are critical to achieving the desired result of gasification to producer gas and regeneration of the refractory oxide employed herein for further use in the residual oil contacting step. Aside from the extremely beneficial effect of not having a hydrogen pressured reaction system, the refractory oxide to oil weight ratio required for the demetalation/desulfurization step of the present combination process is from about 0.1 to about 5, with a preferred range of from about 0.3 to about 1.5. The temperature of the demetalation/desulfurization step of the present combination process must be within the range of from greater than 700°F to about 1100°F, with a preferred temperature range in that step of from about 850°F to about 950°F. The temperature of the gasification step of the present combination process must be within the range of from about 1000°F to about 1500°F, with a preferred temperature range in that step of from about 1200°F to about 1500°F. Further, the refractory oxide is contacted in the gasification step with steam and a free oxygen-containing gas in which the mole ratio of steam to oxygen is from about 3 to about 5, with a preferred ratio of from about 3.5 to about 4.

Figure 1:
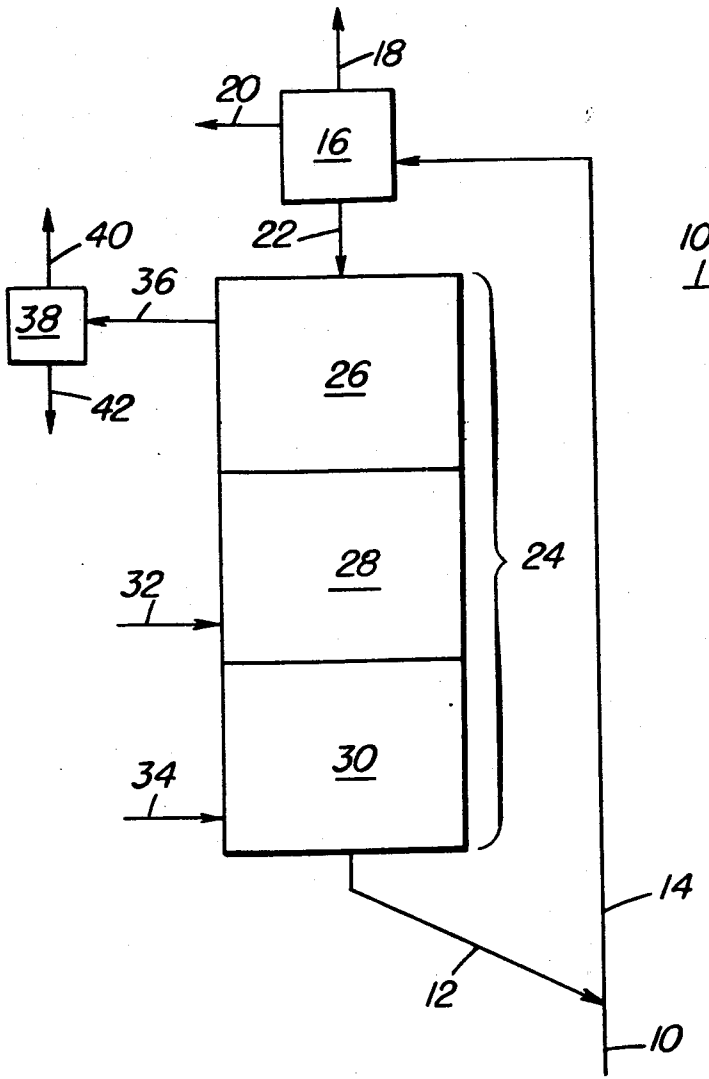
FIG. 1 is a simplified schematic flow diagram of the combination process of the invention.

To facilitate an understanding of the herein described combination process, reference is now made to FIG. 1. In the arrangement of FIG. 1, a residual oil to be treated in accordance herewith is introduced to the process through conduit 10. Said residua, containing sulfur and metal contaminants, is at a temperature of from greater than 700°F to about 1100°F. The conduit 10 is injected with a porous refractory oxide, such as one hereinbefore defined, from conduit 12 to produce a refractory oxide/oil mixture which flows through reaction conduit 14. Said mixture has a refractory oxide to oil weight ratio within the reaction conduit 14 of from about 0.1 to about 5. The flow rate of said mixture through reaction conduit 14 is such that the contact time between the residual oil and the refractory oxide is sufficient to affect substantial removal of metals hereinbefore identified and sulfur from the residual oil.

The mixture then passes from reaction conduit 14 into a refractory oxide separation zone 16, wherein substantial separation of reaction products, i.e. demetalized/desulfurized oil of cracking feed quality; gaseous product and a slurry of spent refractory oxide in remaining oil, occurs. Gaseous product exits said separation zone 16 through conduit 18. Upgraded residual oil of cracking feed quality exits said separation zone 16 through conduit 20. Spent coke-deposited refractory oxide slurried in remaining oil exits said separation zone through conduit 22. The spent refractory oxide in conduit 22 is generally heavily coked as a result of the demetalation/desulfurization reaction which took place in reaction conduit 14.

The contents of conduit 22 are introduced to the gasification step of the process by way of being passed into the gasification reactor 24. Said reactor 24 is comprised of three zones. The first zone 26 is a stripping and heat exchange zone. Downstream of the zone 26 is zone 28, the gasification reaction zone, into which air is injected via conduit 32. The third and final zone in the gasification reactor 24 and downstream of zone 28 is a heat exchange zone 30, into which is injected via conduit 34 steam and air such that the ratio of steam to oxygen is from about 3 to about 5.

Exit conduit 36 from the gasification reactor 24 is located adjacent zone 26 of said reactor 24 and carries a product from reactor 24 to a knock-out drum apparatus 38. The overhead from drum 38, exiting said drum 38 via conduit 40, is producer gas. The bottoms from drum 38, exiting said drum 38 via conduit 42, is additional upgraded residual oil of cracking feed quality.

A further product of the gasification reactor 24, exiting said reactor 24 via conduit 12, is regenerated refractory oxide.

FIG. 2 depicts a typical schematic flow diagram of the combination process of the present invention. Residual oil to be treated by the present process is introduced to said process via conduit 100. Super-heated steam may, if desired, be injected into conduit 100 via conduit 102 whereby approximately 1 percent or less of the steam-residua combination is said super-heated steam. The temperature of the residual oil passing through conduit 100 may be about 600°F and pass therethrough at up to about 24,000 B/D or more. Since the presence of steam in the feed to the present process tends to reduce coke formation and thereby impair metal removal somewhat, it is preferred that little or no steam be employed.

The contents of conduit 100 are passed through heater 104 where the temperature thereof is increased to greater than 700°F to about 1100°F. The heated residual oil further passes into demetalation/desulfurization reactor 108 via conduit 106 from heater 104. Steam may, if desired, be injected into reactor 108 via conduit 110. Again, little or no steam at this step of the process is preferred. The refractory oxide selected for use herein is added to reactor 108 from the top thereof via conduit 112. Coked refractory oxide is withdrawn from reactor 108 through conduit 114 and reaction product, i.e. upgraded residual oil of cracking feed quality, along with by-products and some refractory oxide fines suspended therein is withdrawn from reactor 108 through conduit 116. Inside reactor 108, either in batch or continuous operation, metal and sulfur contaminants are removed from the residual oil feed and the is deposited with coke. The residence time of the reaction contained in reactor 108 is from about 0.8 to about 1.4 hours maximum and the refractory oxide to oil weight ratio is maintained at from about 0.1 to about 5. Additions to and substractions from reactor 108 via conduits 106, 110, 112, 114 and 116 are timed and controlled, as desired, to allow for either batch or continuous operation.

The product contained in conduit 116 is passed therefrom into separator 118, from which emerge three streams. Stream 120 is overhead from separator 118 and comprises light gases and water vapor. Stream 122 is bottom product from separator 118 and comprises refractory oxide fines. Stream 124 comprises upgraded residual oil of cracking feed quality and may comprise all or part of a feed to FCC or HDS units.

The coked refractory oxide contained in conduit 114 is passed therefrom into kiln 126 wherein coke gasification and burning take place. The temperature maintained in kiln 126 is from about 1000°F to about 1500°F. Steam and air (or oxygen) are injected into kiln 126 via conduits 128 and 130, respectively, in such a manner as to provide a steam to oxygen mole ratio of from about 3 to about 5.

Products withdrawn from kiln 126 are two in number. The first, withdrawn via conduit 132 is sent to drop-out pot 134, from which producer gas (low Btu-type gas of approximately 210 Btu/ft$^3$) is withdrawn as overhead via conduit 136. Conduit 138 provides a drop-out path for particulate matter and other impurities entrained in kiln 126 product exiting said kiln via conduit 132.

The second product from kiln 126, withdrawn therefrom via conduit 140 is composed of regenerated suitable for further contacting with residual oil in accordance herewith. Said regenerated refractory oxide is accumulated in bin 142, to which lift air is applied via conduit 144. Said lift air causes said refractory oxide to flow through conduit 146 to surge bin 148, from which refractory oxide is withdrawn via conduit 112 for addition thereof to reactor 108. The flow of refractory oxide through conduit 146 can be up to approximately 700 tons/hour maximum.

In order to more fully illustrate the process of the present invention, the following specific examples, which in no sense limit the invention, are presented.

EXAMPLES 1–3

These demetallization reactions were carried out in a downflow Vycor reactor at atmospheric pressure and at temperatures of 900°F and 950°F. The liquid products were collected at regular intervals and analyzed for the amount of nickel present. Gas samples were analyzed with a Hewlett Packard 7620A gas chromatograph and 12 ft. column of 10% methyl vinyl silicone on firebrick. Total gas produced was measured with a wet-test meter.

The refractory oxide used was a rare earth zeolite Y (6 percent) on a silica-alumina matrix (94 percent). The residuum used as a 400° + Agha Jari having a metal factor of 262. The analysis of the refractory oxide and the residuum along with the run conditions are given in Tables I and II.

The results are also shown in Tables I and II. These results indicate that at a refractory oxide/oil ratio of about ½, this Agha Jari residuum can be upgraded to cracking feed quality. One of the most important qualities of cracking feed is metal content, which is expressed as the hereinbefore defined metal factor. It is noted from analysis of the data generated that a feed of 2–3 metal factor can be obtained at a refractory oxide/oil ratio of about ½.

The typical liquid recovery was 92 volume percent of the charge, while the gas yield was about 6.5 weight percent of the charge. The gas consists mainly of $C_1$, $C_2$ and $C_3$ compounds with a molecular weight of about 45.

TABLE I

ANALYSIS OF LIQUID PRODUCT
Pressure: O psig
On Stream Time: ½ Hr.

| Run No. | Operating Conditions | | Metal Content, ppm | | | | |
|---|---|---|---|---|---|---|---|
| | °F | WHSV | Ni | V | Fe | Na | K |
| Feedstock | — | — | 17 | 89 | 3.2 | 1.0 | 0.5 |
| 1 | 900 | 2 | 0.1 | <0.1 | 0.3 | 2 | 2 |
| 2 | 950 | 2 | 0.1 | <0.1 | <0.1 | 3 | 2 |
| 3 | 950 | 4 | <0.1 | 0.2 | 0.6 | 2 | 2 |

TABLE II

Analysis of Used Refractory Oxide*
Pressure: 0 psig

| Run No. | Operating Condition | | | Metal Content, ppm | | | | |
|---|---|---|---|---|---|---|---|---|
| | °F | WHSV | Hours on Stream | Ni | V | Fe | Na | K |
| Fresh | — | — | — | 44 | 27 | 500 | 500 | 100 |
| 1 | 900 | 2 | 3.5 | 75 | 206 | 400 | 600 | 100 |
| 2 | 950 | 2 | 3.0 | 74 | 194 | 500 | 500 | 100 |
| 3 | 950 | 4 | 4.0 | 71 | 189 | 400 | 500 | 100 |

*The used refractory oxide were extracted with toluene.

EXAMPLE 4

The procedure of Examples 1–3 was followed with silica gel of 3–8 mesh as the refractory oxide. The silica gel was dried prior to use at 120°C for overnight. The reactor was charged with 50cc. of the silica gel and operated at 900°F and 2 WHSV.

The results of this example, as shown in Table III, indicate that at a refractory oxide to oil ratio of 1:2 the Agha Jari residuum was upgraded to cracking feed quality (the metal factor was reduced from about 262 to 2–3).

TABLE III

Analysis of Liquid Product from Example 4
Pressure: O psig

| Time On Stream | Operating Conditions °F | WHSV | Metal Content, ppm Ni | V |
|---|---|---|---|---|
| 30 Mins | 900 | 2 | 0.1 | <0.1 |
| 60 Mins | 900 | 2 | 0.2 | <0.1 |
| 90 Mins | 900 | 2 | 0.2 | <0.1 |

TABLE III-continued

| Analysis of Liquid Product from Example 4 Pressure: O psig | | | | |
|---|---|---|---|---|
| Time On Stream | Operating Conditions °F | WHSV | Metal Content, ppm Ni | V |
| Feed | — | — | 17 | 81 |

EXAMPLES 5–11

These examples were made at atmospheric pressure using the 12 inch long, ½ inch outside diameter Vycor down-flow reactor with a central, longitudinal thermowell. A 4.0 gram charge of (particularly defined in Table IV hereinafter), after having been dried and calcined for 16 hours at 1000°F, was contained in the center of the heated portion of the reactor. The space above and below the refractory oxide bed was filled with 3 mm of Pyrex beads. The center of the refractory oxide bed was maintained at 900° ± 2°F (880° ± 2°F at the top and bottom extremities of the bed). Agha Jari 400° + residuum, having 1.78 weight percent sulfur, was the feedstock and was supplied to the reactor at 7.2 grams per hour (1.8 WHSV) with a syringe pump. Samples of liquid product were periodically taken for sulfur analysis.

first sample, the average sulfur removal obtained thermally was about 20 percent.

It is apparent that at oil/refractory oxide ratios of <1 desulfurization of more than 30% above the thermal level can be obtained. At oil-refractory oxide ratios of >1, total sulfur removal falls rapidly to the thermal value. Although sulfur analyses of the spent refractory oxides were not made, calculations involving total amounts of sulfur removed in two of the runs (Examples 6 and 7 indicated that less than 10% of the available metal oxide had been consumed, if simple stoichiometric conversion to metal sulfides is assumed. It is possible, therefore, that the rapid decrease in desulfurization activity with increasing oil/refractory oxide ratio observed in all cases is due not to consumption of metal oxide, but rather to the increasing coke deposition. However, since pure $\gamma$-alumina (Example 11) performed as well as or better than the metal containing $\gamma$-and $\theta$-aluminas, an alternate explanation of sulfur removal may be that the high surface area substrate simply offers increased area for thermal degradation, and the effect of the metal oxides is negligible. The lower sulfur removal capacity of $\alpha$-alumina (Example 5) is consistent with this explanation, and rapid loss of desulfurization activity with increasing coke deposition would also be expected.

TABLE IV

| Refractory Oxides Used in Examples 5–11 | | | | |
|---|---|---|---|---|
| Example | Refractory Oxide | Source | Surface area. ($m^2/g$) | Composition |
| 5 | $\alpha$-$Al_2O_3$ | Girdler | 10 | ⅛" × ⅛" Tablets |
| 6 | Co-Mo/$Al_2O_3$ | Harshaw CoMo-0601 | 161 | ⅛" × ⅛" Tablets; 3 wt.% cobalt; 9 wt. % $MoO_3$ on $Al_2O_3$ |
| 7 | Mo/$Al_2O_3$ | Harshaw Mo-0502 | 64 | ⅛" × ⅛" Tablets; 10 wt.% $MoO_3$ on $Al_2O_3$ |
| 8 | Bauxite | | 198 | 6–10 mesh granules; 3.3 wt.% $Fe_2O_3$; 10–15 wt.% $SiO_2$ |
| 9 | GBN-3 | Sturgeon Bay Manganese Nodules | 100–200 | 6–10 mesh granules; 50.5 wt.% $Fe_2O_3$; 5.5 wt.% $MnO_2$; 33.2 wt.% $SiO_2$ 3.0 wt.% $Al_2O_3$ |
| 10 | Cr/$Al_2O_3$ | Harshaw Cr-0104 | 80 | ⅛" × ⅛" Tablets; 5.0 wt.% $Cr_2O_3$ on $Al_2O_3$ |
| 11 | $\gamma$-$Al_2O_3$ | Girdler T-126 | 220 | 6–10 mesh granules |

TABLE V

| Blank Run | | | Example 5 | | | Example 6 | | | Example 7 | | |
|---|---|---|---|---|---|---|---|---|---|---|---|
| Oil: Refractory Oxide | Wt% S | %S Removal | Oil: Refractory Oxide | Wt% S | %S Removal | Oil: Refractory Oxide | Wt% S | %S Removal | Oil: Refractory Oxide | Wt% S | %S Removal |
| — | 1.28 | 28.4 | 0.90 | 1.13 | 36.5 | 0.90 | 0.81 | 54.5 | 1.35 | 1.09 | 38.8 |
| — | 1.42 | 21.1 | 1.80 | 1.27 | 28.7 | 1.80 | 1.24 | 30.3 | 1.80 | 1.22 | 31.5 |
| — | 1.43 | 20.6 | 2.73 | 1.38 | 22.5 | 2.70 | 1.36 | 23.6 | 2.70 | 1.33 | 25.3 |
| — | 1.48 | 17.8 | 3.60 | 1.36 | 23.6 | 3.66 | 1.39 | 21.9 | 3.90 | 1.39 | 21.9 |
| — | 1.43 | 20.6 | 4.50 | 1.38 | 22.5 | 4.20 | 1.40 | 21.3 | 4.50 | 1.41 | 21.8 |
| | | | 5.40 | 1.36 | 23.6 | 4.80 | 1.46 | 17.8 | 5.40 | 1.42 | 20.2 |
| | | | | | | 6.00 | 1.39 | 21.9 | 6.30 | 1.43 | 19.7 |
| | | | | | | 7.20 | 1.39 | 21.9 | | | |
| 0.60 | 0.76 | 57.3 | 0.60 | 0.77 | 56.7 | 0.60 | 0.83 | 53.4 | 0.60 | 0.78 | 56.1 |
| 1.20 | 1.01 | 43.3 | 1.20 | 1.08 | 39.3 | 1.20 | 1.02 | 42.6 | 1.20 | 0.42 | 51.6 |
| 1.80 | 1.11 | 37.6 | 1.80 | 1.19 | 33.1 | 1.80 | 1.19 | 33.2 | 1.80 | 1.04 | 41.5 |
| 2.70 | 1.23 | 30.9 | 2.70 | 1.32 | 25.8 | 2.70 | 1.34 | 24.7 | 2.70 | 1.10 | 38.2 |
| 3.66 | 1.32 | 25.8 | 3.60 | 1.38 | 22.5 | 3.60 | 1.44 | 19.1 | 3.60 | 1.29 | 27.5 |
| 4.50 | 1.37 | 23.0 | 4.50 | 1.40 | 21.3 | 4.50 | 1.49 | 16.3 | 4.50 | 1.33 | 25.3 |
| 6.30 | 1.41 | 20.8 | 5.40 | 1.40 | 21.3 | 5.31 | 1.54 | 13.5 | 5.90 | 1.45 | 18.5 |
| 7.20 | 1.46 | 18.0 | 6.30 | 1.38 | 22.5 | 6.75 | 1.52 | 14.6 | 7.30 | 1.47 | 17.4 |
| | | | 7.20 | 1.34 | 24.7 | | | | | | |

The results of all the runs are summarized in Table V. The blank run (reactor filled only with 3 mm Pyrex beads) was made to determine the sulfur removal effected by simple thermal degradation. Samples from this run were taken at 30 minute intervals. Beyond the

EXAMPLE 12

Sulfur removal capacity of the bauxite of Example 8 was tested for steam/air regeneration stability by subjecting it to a series of desulfurization/regeneration cycles as follows: using the procedure of Examples 5–11 residuum was flowed over the refractory oxide at 2.0 WHSV and 900°F until an oil/refractory oxide ratio of about 1.0 had been reached. After stripping one hour at 900°F with 8.0 gram per hour of steam, the coked substrate was heated to 1400°F under nitrogen and partially regenerated with 4.0 grams per hour of steam for 16 hours. The temperature was then lowered to 900°F, and a 500 cc/minute stream of air was passed through the reactor for two hours to complete the regeneration. A final flush with nitrogen completed the cycle, and the flow of residuum was started again. The sulfur contents of liquid products from six such successive cycles are given in Table VI. These results indicate that the sulfur removal capacity of bauxite is not greatly affected by steam/air regeneration.

TABLE VI

Sulfur Removal Capacity of a Refractory Oxide for Use Herein

| Cycle[1] | Oil/Refractory Oxide Ratio | Wt.%S[2] | %S Reduction |
|---|---|---|---|
| 1 | 0.75 | 0.57 | 68.0 |
| 2 | 0.95 | 0.89 | 50.0 |
| 4 | 1.07 | 0.90 | 49.4 |
| 5 | 0.68 | 0.78 | 56.2 |
| 6 | 0.78 | 0.66 | 62.9 |

(1) Desulfurization/Regeneration cycles.
(2) Sulfur content of liquid product of desulfurization step of process.

EXAMPLE 13

This experiment was conducted to illustrate the process of the present invention wherein detailed properties of liquid product, i.e. residual oil of cracking feed quality, and gaseous product, were determined. It was conducted in a 33mm. diameter × 21in. long quartz reactor, completely filled with the refractory oxide being tested, i.e. α-alumina. Two axial thermowells were provided to enable determinations of detailed temperature profiles while running. Provisions were made for periodic removal of gas and liquid samples for analyses. Total gas evolved was measured in all cases with a Wet-Test Meter.

The feedstock in this experiment was an Agha Jari 400° + long residuum having the properties shown below:

| | |
|---|---|
| Gravity, °API | 24.9 |
| Sulfur, Wt.% | 1.89 |
| Nitrogen, Wt. % | 0.21 |
| Carbon Residue, Wt.% | 5.14 |
| Nickel, ppm | 17 |
| Vanadium, ppm | 89 |
| Distillation, °F at | |
| 10% over | 521 |
| 30% over | 634 |
| 50% over | 790 |
| 70% over | 940 |
| 80% over | 1050 (cracked) |

The refractory oxide material, after drying and calcining at 1000°F for 16 hours was charged into the reactor and the total weight of the filled reactor was recorded. The refractory oxide was heated to reaction temperature under flowing nitrogen. After starting the flow of feed and attaining temperature equilibrium along the reactor interior, a detailed temperature profile was measured in order to determine the amount of "active" refractory oxide. When the desired number of gas and liquid samples had been collected, the feed (2.0 WHSV) was stopped, and the refractory oxide was stripped for one hour with 10 g/hr. of steam at 900°F to remove residual feedstock and gases. The reactor was then cooled to room temperature under nitrogen. Coke made was assumed to be the total weight gain of the reactor after steamstripping.

The results of the experiment are recorded in Table VII.

TABLE VII

Products From Residuum Treatment With α-Alumina At 900°F and 2.0 WHSV OIL/REFRACTORY OXIDE WEIGHT RATIO

| | 0.48 | 0.95 | 1.41 | 1.87 | 2.30 | 2.74 | 3.18 | 3.62 | 4.04 | 4.46 |
|---|---|---|---|---|---|---|---|---|---|---|
| Gas (3.0%) | | | | | | | | | | |
| Composition, Mole % | | | | | | | | | | |
| Hydrogen | | 21.0 | | 35.5 | | 30.3 | | 30.2 | | |
| Methane | | 17.3 | | 20.1 | | 22.4 | | 25.3 | | |
| Ethene | | 3.5 | | 2.7 | | 2.7 | | 2.4 | | |
| Ethane | | 9.9 | | 8.7 | | 9.4 | | 9.7 | | |
| Propene | | 0.0 | | 0.0 | | 0.0 | | 1.7 | | |
| Propane | | 7.0 | | 5.4 | | 5.5 | | 5.5 | | |
| Butenes | | 11.0 | | 6.8 | | 7.1 | | 5.8 | | |
| Isobutane | | 1.2 | | 0.9 | | 0.8 | | 0.7 | | |
| n-Butane | | 3.9 | | 2.6 | | 2.9 | | 2.7 | | |
| $C_5$'s | | 11.6 | | 7.1 | | 8.0 | | 6.3 | | |
| $C_6$'s | | 7.0 | | 4.2 | | 5.0 | | 3.4 | | |
| Hydrogen Sulfide | | 6.6 | | 5.6 | | 6.0 | | 6.3 | | |
| Liquid (88.6%) | | | | | | | | | | |
| Properties | | | | | | | | | | |
| Nickel, ppm | — | 0.1 | 0.1 | 0.9 | 0.9 | 0.4 | 0.7 | 0.7 | 2.0 | 0.7 |
| Sulfur, wt % | 1.09 | 1.34 | 1.45 | 1.48 | 1.49 | 1.51 | 1.54 | 1.54 | 1.55 | 1.51 |
| Nitrogen, wt % | 0.052 | 0.085 | 0.106 | 0.111 | 0.111 | 0.111 | 0.133 | 0.133 | 0.133 | 1.22 |
| CCR, wt % | 0.14 | 0.33 | 0.95 | 0.85 | 0.74 | 1.07 | 0.85 | 1.16 | 1.06 | 1.09 |
| Distillation, °F at | | ← | | | → | ← | | | → | |
| 10% over | | | 521 | | | | 518 | | | |
| 30% " | | | 595 | | | | 586 | | | |
| 50% " | | | 711 | | | | 724 | | | |
| 70% " | | | 807 | | | | 835 | | | |
| 90% " | | | 936 | | | | 992 | | | |
| Coke (8.4%) | | | | | | | | | | |

EXAMPLE 14

This experiment was conducted essentially as was Example 13, with the exceptions that the refractory oxide was manganese nodules and the feedstock was an Agha Jari 400°+ residuum having the properties shown below:

| | |
|---|---|
| Gravity, °API | 25.9 |
| Sulfur, Wt. % | 1.80 |
| Nitrogen, Wt. % | 0.19 |
| Carbon Residue, Wt. % | 2.97 |
| Nickel, ppm | 12 |
| Vanadium, ppm | 44 |
| Distillation, °F at | |
| 10% over | 526 |
| 30% over | 633 |
| 50% over | 764 |
| 70% over | 919 |
| 84% over | 1115 (cracked) |

The results of the experiment are recorded in Table VIII.

EXAMPLE 15

This experiment was conducted as in Example 14. The refractory oxide used here, however, was the steam-regenerated refractory oxide of Example 14.

The results of the experiment are recorded in Table IX.

TABLE IX

Products From Residuum Treatment With Steam-Regenerated Manganese Nodules at 900°F and 2.0 WHSV

| | Oil/Refractory Oxide Weight Ratio | | | | | | | | | | | |
|---|---|---|---|---|---|---|---|---|---|---|---|---|
| | 0.90 | 1.77 | 2.68 | 3.56 | 4.43 | 5.32 | 6.18 | 7.10 | 8.01 | 9.00 | 9.94 | 10.82 |
| Gas (2.1%) | | | | | | | | | | | | |
| Composition, Mole % | | | | | | | | | | | | |
| Hydrogen | | | 27.9 | | | | | 26.3 | | 22.3 | | 23.1 |
| Methane | | | 26.1 | | | | | 30.7 | | 33.2 | | 33.7 |
| Ethene | | | 3.3 | | | | | 2.7 | | 2.7 | | 2.5 |
| Ethane | | | 11.2 | | | | | 11.3 | | 11.8 | | 11.7 |
| Propene | | | 4.4 | | | | | 2.9 | | 2.8 | | 2.6 |
| Propane | | | 6.9 | | | | | 6.2 | | 6.4 | | 6.3 |
| Butenes | | | 6.1 | | | | | 5.8 | | 6.0 | | 5.8 |
| Isobutane | | | 0.7 | | | | | 0.7 | | 0.7 | | 0.7 |
| n-Butane | | | 3.8 | | | | | 3.2 | | 3.3 | | 3.2 |
| $C_5$'s | | | 6.7 | | | | | 6.7 | | 6.9 | | 6.7 |
| $C_6$ | | | 2.9 | | | | | 3.5 | | 3.7 | | 3.5 |
| Hydrogen Sulfide | | | 0.0 | | | | | 0.0 | | 0.1 | | 0.1 |
| Liquid (91.9%) | | | | | | | | | | | | |
| Properties | | | | | | | | | | | | |
| Nickel, ppm | 0.3 | — | 0.4 | — | 0.4 | — | 0.3 | — | 0.6 | — | 0.8 | — |
| Sulfur, wt % | 0.88 | 1.26 | 1.43 | 1.43 | — | — | — | — | — | — | — | — |
| Nitrogen, wt % | 0.030 | — | 0.10 | — | 0.11 | — | 0.11 | — | 0.12 | — | 0.12 | — |
| CCR, Wt % | 0.10 | 0.24 | 0.29 | 0.41 | 0.22 | 0.22 | 0.29 | 0.56 | 0.58 | 0.70 | 0.76 | 0.75 |
| Distillation, °F at | | | | | | | | | | | | |
| 10% Over | | | | 514 | | | | | 511 | | | |
| 30% Over | | | | 604 | | | | | 604 | | | |
| 50% Over | | | | 705 | | | | | 708 | | | |
| 70% Over | | | | 807 | | | | | 820 | | | |
| 90% Over | | | | 979 | | | | | 965 | | | |
| Coke (6.0%) | | | | | | | | | | | | |

EXAMPLES 16–23

These examples were conducted to demonstrate the effectiveness of the coke gasification step of the present combination process. Examples 16 and 17 were conducted using 6–10 mesh spheres of a refractory oxide composition comprising 6 percent rare earth zeolite Y on a silica-alumina matrix. Examples 18, 19

TABLE VIII

Products From Residuum Treatment With Manganese Nodules at 900°F and 2.0 WHSV

| | Oil/Refractory Oxide Weight Ratio | | | | | | | | | | | |
|---|---|---|---|---|---|---|---|---|---|---|---|---|
| | 0.90 | 1.76 | 2.63 | 3.50 | 4.37 | 5.24 | 6.14 | 7.03 | 7.92 | 8.90 | 9.78 | 10.68 |
| Gas (4.3%) | | | | | | | | | | | | |
| Composition, Mole % | | | | | | | | | | | | |
| Hydrogen | | 84.7 | | 75.7 | | 66.7 | | 53.2 | | 46.0 | | 43.6 |
| Methane | | 6.0 | | 9.5 | | 13.0 | | 19.8 | | 23.4 | | 25.4 |
| Ethene | | 0.8 | | 1.2 | | 1.6 | | 2.0 | | 2.1 | | 2.1 |
| Ethane | | 2.0 | | 3.4 | | 4.8 | | 6.9 | | 7.9 | | 8.3 |
| Propene | | 0.6 | | 0.7 | | 0.8 | | 1.5 | | 1.7 | | 1.6 |
| Propane | | 1.2 | | 2.0 | | 2.7 | | 3.7 | | 4.2 | | 4.4 |
| Butenes | | 1.5 | | 2.4 | | 3.3 | | 4.0 | | 4.5 | | 4.5 |
| Isobutane | | 0.3 | | 0.3 | | 0.4 | | 0.4 | | 0.5 | | 0.5 |
| n-Butane | | 0.5 | | 0.9 | | 1.3 | | 1.8 | | 2.1 | | 2.1 |
| $C_5$'s | | 1.8 | | 2.6 | | 3.5 | | 4.3 | | 5.0 | | 4.8 |
| $C_6$'s | | 0.5 | | 1.1 | | 1.7 | | 2.3 | | 2.7 | | 2.5 |
| Hydrogen Sulfide | | 0.0 | | 0.0 | | 0.0 | | 0.0 | | 0.0 | | 0.0 |
| Liquid (85.0%) | | | | | | | | | | | | |
| Properties | | | | | | | | | | | | |
| Nickel, ppm | — | 0.1 | 0.1 | 0.1 | 0.2 | 0.1 | 0.1 | 0.2 | 0.2 | 0.3 | 0.3 | 0.4 |
| Sulfur, wt % | 0.38 | 0.62 | 0.93 | 1.13 | 1.20 | 1.29 | 1.36 | 1.39 | 1.42 | 1.42 | 1.46 | 1.46 |
| Nitrogen, wt % | 0.010 | 0.019 | 0.042 | 0.057 | 0.070 | 0.080 | 0.090 | 0.097 | 0.101 | 0.105 | 0.112 | 0.113 |
| CCR, wt % | — | 0.01 | 0.23 | 0.42 | 0.19 | 0.49 | 0.25 | 0.41 | 0.44 | 0.39 | 0.41 | 0.32 |
| DISTILLATION,°F AT | | | | | | | | | | | | |
| 10% Over | | | | | 502 | | | | 507 | | | |
| 30% Over | | | | | 572 | | | | 597 | | | |
| 50% Over | | | | | 655 | | | | 689 | | | |
| 70% Over | | | | | 746 | | | | 787 | | | |
| 90% Over | | | | | 882 | | | | 942 | | | |

and 20 were conducted using North American bauxite (3/8 inch extrudate containing 2.3 percent iron and 10–15 percent silica). Examples 21, 22 and 23 were conducted using ⅛ inch × 3/16 inch pellets of γ-alumina as the solid material catalyst.

The refractory oxides individually were subjected to the demetalation/desulfurization step of the present process according to the following general procedure:

The demetalation/desulfurization steps were carried out in a vertical, fixed-bed system at atmospheric pressure, using Agha Jari 450° + atmospheric resid as feedstock. The reactor was a 1 ½ in. diameter Vycor tube, 12 in. long, with a central, longitudinal thermowell. Gas evolutions were measured with a Wet-Test Meter, and provisions were made for withdrawing liquid product samples when desired. The refractory oxide charge (20.0 grams) was centered in the heated portion of the reactor, and the space above and below the bed was filled with 10–20 mesh Vycor chips. All runs were made at 1.8 WHSV and 800°F, with a temperature gradient of ≤ 5°F along the refractory oxide bed.

Analysis indicated that the refractory oxides of Examples 16 and 17 contained 4.9 weight percent carbon; those of Examples 18, 19 and 20 contained 15.9 weight percent carbon and those of Examples 21, 22 and 23 contained 11.9 weight percent carbon.

The gasification steps were carried out in a ½ inch (OD) × 12 inch long Vycor, down-flow reactor, using 2.00 gram charges of coked refractory oxide surrounding a thin-walled thermowell. The reactor space above and below the refractory oxide bed was packed with 10–20 mesh Vycor chips. Water was fed with a syringe pump at 2.00 grams/hour, vaporizing upon contact with the hot Vycor chips. Unreacted water was collected in a drip-pot and total volume of gas evolved was measured with a Wet-Test meter. Samples of effluent were taken periodically for mass spectrometric analysis of $H_2$, CO, $CO_2$, $N_2$ and $O_2$ contents.

The results of these examples are set forth in Table X.

TABLE X

| Gasification of Coke Deposits on Substrate | | | | |
|---|---|---|---|---|
| Example | Temperature, °F | k(×10²min.⁻¹) [1] | Time, minutes | Unreacted Coke, weight percent |
| 16 | 1400 | 0.14 | 120 | 80 – 81 |
| | | | 240 | 69 – 70 |
| 17 | 1500 | 0.50 | 80 | 65 |
| | | | 120 | 54 |
| | | | 240 | 30 – 31 |
| 18 | 1300 | 0.15 | 90 | 81 |
| | | | 120 | 77 |
| 19 | 1400 | 0.41 | 80 | 67 – 68 |
| | | | 120 | 59 |
| 20 | 1500 | 0.90 | 60 | 57 – 58 |
| | | | 70 | 53 – 54 |
| 21 | 1300 | 0.21 | 60 | 81 |
| | | | 120 | 72 |
| | | | 140 | 69 |
| 22 | 1400 | 0.50 | 60 | 71 – 72 |
| | | | 120 | 54 – 55 |
| | | | 140 | 50 – 51 |
| 23 | 1500 | 1.14 | 40 | 62 – 63 |
| | | | 60 | 51 |

[1] First-order rate constants measuring carbon consumption rate.

What is claimed is:

1. A process for residual oil demetalation and desulfurization and resulting coke gasification which comprises contacting said residual oil with a porous refractory oxide in the absence of added hydrogen, at a temperature of from greater than 700°F to about 1100°F and a porous refractory oxide to oil weight ratio of from about 0.1 to about 5, recovering from said residual oil contacting step upgraded residual oil of cracking feed quality and coke-deposited refractory oxide, contacting said coke-deposited refractory oxide with steam and a free oxygen containing gas at a temperature of from about 1000°F to about 1500°F and a mole ratio of steam to oxygen of from about 3 to about 5, and recovering from said coke-deposited refractory oxide contacting step producer gas and regenerated coke-free refractory oxide.

2. The process of claim 1 wherein the residual oil contacting step is conducted at a temperature of from about 850°F to about 950°F and a porous refractory oxide to oil weight ratio of from about 0.3 to about 1.5, and said coke-deposited refractory oxide contacting step is conducted at a temperature of from about 1200°F to about 1500°F.

3. The process of claim 2 wherein said mole ratio of steam to oxygen is from about 3.5 to about 4.

4. The process of claim 3 wherein said free oxygen containing gas is air.

5. The process of claim 1 wherein said residual oil is a high boiling range residual oil boiling above about 400°F.

6. The process of claim 5 wherein said residual oil includes components obtained by fractionation of crude oils selected from the group consisting of Pennsylvania, Midcontinent, Gulf Coast, West Texas, Amal, Agha Jari, Kuwait, Barco and Arabian.

7. The process of claim 1 wherein said porous refractory oxide is a spent crystalline aluminosilicate.

8. The process of claim 1 wherein said porous refractory oxide is alumina.

9. The process of claim 1 wherein said porous refractory oxide is selected from the group consisting of siliceous materials.

10. The process of claim 9 wherein said siliceous material is silica.

11. The process of claim 9 wherein said siliceous material is a combination of silica with an oxide of a metal of Groups II—A, III—A, IV—B, and V—B of the Periodic Table.

12. The process of claim 7 wherein said crystalline aluminosilicate is zeolite ZMS—5.

13. A process for residual oil demetalation and desulfurization and resulting coke gasification which comprises contacting said residual oil in the absence of added hydrogen and at a temperature of from greater than 700°F to about 1100°F with a porous refractory oxide, separating the product of the residual oil contacting step into residual oil of cracking feed quality, gaseous product and coke-deposited refractory oxide, recovering the products of the separating step, contacting said coke-deposited refractory oxide with steam and a free oxygen containing gas at a temperature of from about 1000°F to about 1500°F and a mole ratio of steam to oxygen of from about 3 to about 5, recovering from said coke-deposited refractory oxide contacting step the products of gasification of the coke deposited on said coke-depostied refractory oxide, said products of gasification consisting essentially of producer gas and coke-free refractory oxide.

* * * * *

UNITED STATES PATENT AND TRADEMARK OFFICE

CERTIFICATE OF CORRECTION

PATENT NO. : 3,983,030

DATED : September 28, 1976

INVENTOR(S) : MICHAEL P. ROSYNEK ET AL.

It is certified that error appears in the above-identified patent and that said Letters Patent are hereby corrected as shown below:

Column 16, line 65 "ZMS-5" should read --ZSM-5--.

Signed and Sealed this

Twenty-first Day of December 1976

[SEAL]

*Attest:*

RUTH C. MASON
*Attesting Officer*

C. MARSHALL DANN
*Commissioner of Patents and Trademarks*